US005127825A

United States Patent [19]

Tendick, Sr.

[11] Patent Number: 5,127,825

[45] Date of Patent: Jul. 7, 1992

[54] BURNER ASSEMBLY FOR OIL LAMPS USING PLASTIC FUEL CONTAINERS

[75] Inventor: Donald W. Tendick, Sr., Wauwatosa, Wis.

[73] Assignee: Lamplight Farms, Inc., Menomonee Falls, Wis.

[21] Appl. No.: 763,958

[22] Filed: Sep. 23, 1991

[51] Int. Cl.[5] ..... F23D 3/24

[52] U.S. Cl. ..... 431/320; 362/180

[58] Field of Search ..... 431/320–324, 431/301, 302, 314, 315, 145, 146, 144, 298; 362/180, 181; 126/96, 95, 45, 46, 47, 48, 260, 255

[56] References Cited

U.S. PATENT DOCUMENTS

| | | | |
|---|---|---|---|
| 693,070 | 2/1902 | Rosenbluth | 431/323 |
| 1,142,234 | 6/1915 | Bryson | 431/320 |
| 4,025,290 | 5/1977 | Giangiulio | 431/324 |
| 4,728,286 | 3/1988 | Olsen | 431/320 |
| 4,805,076 | 2/1989 | Menter | 362/180 |
| 4,892,711 | 1/1990 | Tendick, Sr. | 422/125 |
| 5,000,678 | 3/1991 | Thompson | 431/320 |

FOREIGN PATENT DOCUMENTS

| | | | |
|---|---|---|---|
| 654454 | 4/1929 | France | 362/180 |

*Primary Examiner*—James C. Yeung

*Attorney, Agent, or Firm*—Michael, Best & Friedrich

[57] ABSTRACT

The burner assembly includes a canister molded from a synthetic plastic material and having a neck portion defining an opening for introducing a combustible liquid into the canister, a seat member and a wick holder. The seat member includes a sleeve portion, which fits snugly inside the canister opening and has an annular collar which extends downwardly over and peripherally around an outer lip on the neck portion of the canister and is crimped onto that lip. The wick holder is removably mounted in the seat and can be removed to refill the canister. Complementary grooves on the wick holder and projections on the seat member permit the wick holder to be releasably locked in the installed position.

8 Claims, 1 Drawing Sheet

BURNER ASSEMBLY FOR OIL LAMPS USING PLASTIC FUEL CONTAINERS

BACKGROUND OF THE INVENTION

I. Field of the Invention

The invention relates to burner assemblies and, more particularly, to burner assemblies used in lamps, decorative lighting devices and the like and having a plastic fuel container or canister.

Burner assemblies for lamps, decorative lighting devices and the like typically include a canister containing liquid fuel and having a raised neck forming an opening through which fuel is introduced into the canister and a cap for holding a wick and covering the canister. The cap typically is stamped from a metal and the canister typically is molded from a plastic material.

II. Description of the Prior Art

In one type of burner assembly, the cap has a raised central portion for holding a wick and a peripheral collar which fits over the rim of the canister neck and is crimped underneath a radially outwardly extending lip on the canister neck to form a seal and lock the cap in place on the canister. Representative prior art patents disclosing such an arrangement include U.S. Giangiulio Pat. No. 4,025,290, U.S. Menten Pat. No. 4,805,076 and U.S. Tendick Pat. No. 4,892,711.

The metal caps of some of these constructions can transfer heat from a burning wick to the plastic material in the region of the rim of the canister neck. The plastic material can soften and cause the seal between the canister neck and the cap collar to be broken. When this occurs, the liquid fuel can leak past the collar any time the canister is tipped over or jostled.

U.S. Thompson Pat. No. 5,000,678 discloses a cap construction which is designed to alleviate this and other shortcomings associated with prior arrangements. In this construction, the cap includes an annular, peripheral collar which fits over the outer lip of the canister neck. The cap includes an annular inner flange which fits snugly inside the canister neck so that, when the collar is crimped over the outer lip on the canister neck, the upper part of the canister neck is sandwiched between the outer collar and the inner flange.

In all the above constructions, the metal cap is permanently affixed to the canister. Thus, the canister cannot be refilled with fuel and, instead, the entire burner assembly is discarded after all the fuel has been used. It is known to use a one-piece wick holder which is removably mounted on a refillable plastic canister by providing mating threads on the wick holder and the canister. Because of the heat transferred from a burning wick to the plastic material in the region of the threads via the metal wick holder, the plastic material softens, causing the threads to lose their original shape and the threads tend not to return to their original shape upon cooling. Consequently, after several softening and cooling cycles during use, the shape of the threads can change enough to prevent the wick holder from being suitably affixed to the canister after it has been removed for refilling the canister.

U.S. Olsen Pat. No. 4,728,286 discloses a lamp including a base, a disposable fuel container having a rupturable cover which is press fitted inside an opening in the container and a wick support removably mounted on the container cover. The cover includes three circumferentially spaced projections which snap over a neck surrounding the container opening. Thus, in addition to the container not being refillable, there is no external means on either the container or the wick support to assist in preventing the container neck from being misshapened by heat transferred from a burning wick.

SUMMARY OF THE INVENTION

An object of this invention is to provide a burner assembly for lamps, decorative lighting devices and the like including a canister and a cap for both closing the canister and holding a wick which is arranged so that the cap can be conveniently removed to refill the canister.

Another object of the invention is to provide such a burner assembly including a cap which provides a positive seal between the cap and the canister throughout the life of the burner assembly and yet facilitates removal to permit the canister to be refilled.

Other objects, aspects and advantages of the invention will become apparent to those skilled in the art upon reviewing the following detailed description, the drawing and the appended claims.

The invention provides a burner assembly including a canister containing a combustible liquid and having a neck portion defining an opening for introducing the combustible liquid into the canister, a seat member mounted on the neck portion of the canister and a wick holder which is mounted in the seat member to cover the canister opening and can be removed to refill the canister. The neck portion of the canister terminates in an upper rim having an annular lip extending radially outwardly from the outer wall of the neck portion. The seat member has a sleeve portion which fits in sealing engagement with the inner wall of the canister neck portion and an annular collar which extends downwardly over and peripherally around the outer surface of the lip on the canister neck portion to capture the upper rim of the neck portion between the collar and the sleeve portion of the seat member. The wick holder has a top wall including an aperture for receiving a wick and a tubular portion which is removably mounted inside the sleeve portion of the seat member. Locking means are provided for releasably holding the wick holder in an installed position. In a preferred embodiment, the locking means includes complimentary projections in the inner surface of the sleeve portion of the seat member and generally L-shaped shaped grooves in the outer surface of the tubular portion of the wick holder.

DESCRIPTION OF THE PREFERRED EMBODIMENTS

Figure 1:
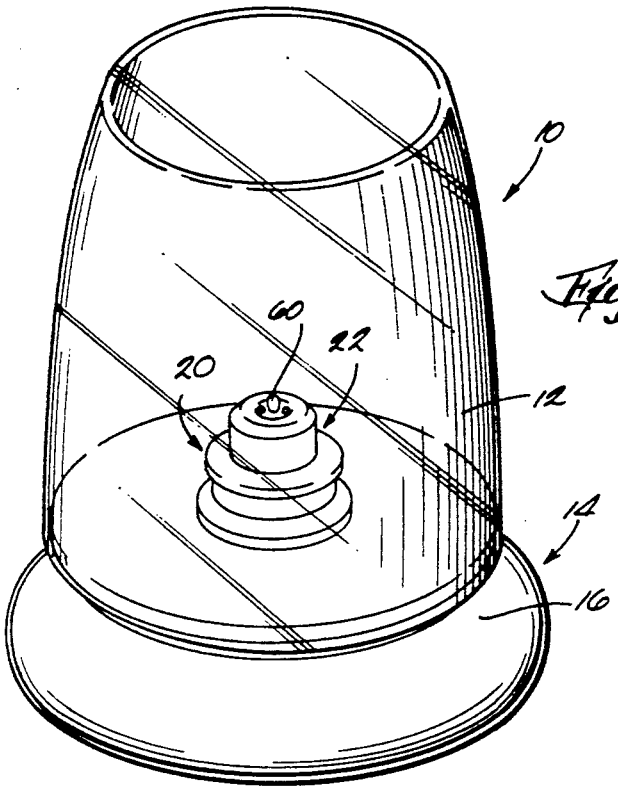
FIG. 1 is a perspective view of a decorative lamp including a burner assembly embodying the invention.

Illustrated in FIG. 1 is a decorative lamp 10 including a chimney 12 which is removably mounted on a burner assembly 14 embodying the invention.

Figure 2:
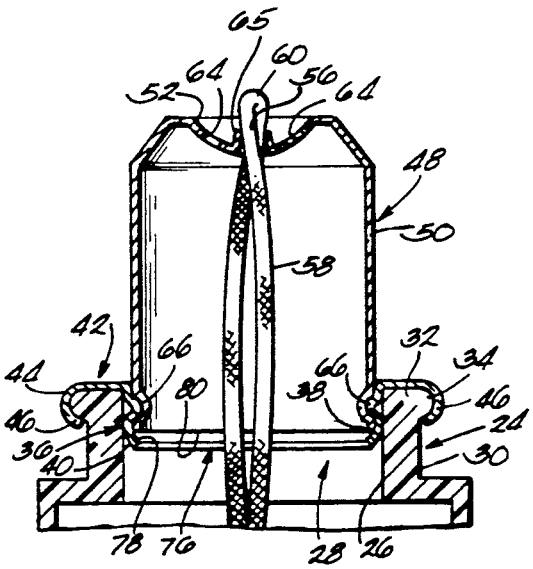
FIG. 2 is an enlarged, fragmentary sectional view of the burner assembly illustrated in FIG. 1.

The burner assembly 14 (FIG. 2) includes a canister 16 containing a combustible liquid, such as mineral spirits or a refined paraffin-based oil, a seat member 20 and a wick holder 22. The chimney 12 serves to dissipate light and can be transparent, translucent and/or colored and can have a smooth or textured surface to provide the desired aesthetic appearance and/or light transmission. The chimney 12 is held in place on the canister 16 by a frictional fit. The canister 16 preferably is molded from a suitable inexpensive thermoplastic material, such as polyvinyl chloride, or a thermosetting material and has an upstanding neck portion 24 including an annular inner wall 26 defining a circular opening 28 through which the combustible liquid is introduced into the canister 16. The neck portion 24 has an outer wall 30 and terminates in an upper rim 32 including an annular lip 34 which extends radially outwardly from the outer wall 30 of the neck portion 24.

The seat member 20 preferably is made from a thin metal, such as tin-plated steel, but can be made from other suitable materials, The seat member 20 has a tubular sleeve portion 36 including inner and outer surfaces 38 and 40 and an outer portion 42 including an annular peripheral collar 44. The sleeve portion 36 of the seat member 20 extends down into the canister opening 28 and the outer surface 40 fits into sealing engagement with the inner wall 26 of the canister neck portion 24.

The collar 44 of the seat member 20 fits snugly over and is crimped against the neck portion lip 34, preferably with the lower portion 46 bent under the lower edge of the lip 34, to sandwich or capture the lip 34 and the upper portion of the neck portion 24 between the sleeve portion 36 and the collar 44. A positive seal between the sleeve portion 36 of the seat member 20 and the inner wall 26 of the neck portion 24 is maintained throughout the life of the burner assembly 14 because the sleeve portion 36 prevents inward displacement of the upper part of the neck portion 24 when the material in that region softens during burning and the collar 44 prevents outward displacement.

The wick holder 22 is preferably made from the same material as the seat member 20 and includes a tubular portion 48 having an outer surface 50 and a top wall 52. The lower part of the tubular portion 48 extends downwardly inside the sleeve portion 36 of the seat member 20. The wick holder 22 is movably between the installed position illustrated in FIG. 2 wherein the outer surface 50 is in close proximity with the inner surface 38 of the sleeve portion 36 of the seat member 20 to cover the canister opening 28 and a fill position wherein the wick holder 22 is fully withdrawn from the seat member 20 to open the canister for refilling with a combustible liquid.

The top wall 52 of the wick holder 22 has a central aperture 56 for receiving an elongated wick 58. An upper portion 60 of the wick 58 extends outwardly from the top wall 52 and is exposed to the lighting and a lower portion (not shown) which extends into the combustible liquid when the wick holder 22 is installed in the seat member 20. The top wall 52 also includes a pair of small openings 64 which serve as pressure relief ports. In the preferred embodiment illustrated, the portion of the top wall 52 surrounding the aperture 56 has a concave shape to promote collection of any liquid leaking through the openings 64 and/or past the wick 58, in which case the openings 64 also serve as drains.

Figure 4:
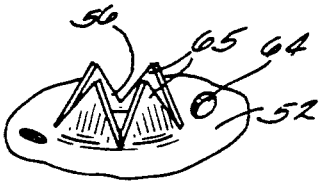
FIG. 4 is an enlarged, fragmentary, perspective view of the top wall of the wick holder in the vicinity of the aperture for receiving the wick, shown with the wick removed.

The wick holder 22 preferably is formed by a metal stamping operation. As best illustrated in FIG. 4, during the stamping operation, a plurality (e.g., 4) of upwardly extending ears 65 surrounding the aperture 56 are formed from the portion of the top wall 52 pushed out to form the aperture 56. The ears 65 have a triangular shape and are arranged so that, after the upper portion 60 of the wick 58 has been inserted through the aperture 56, they can be squeezed against the wick 58 to lock it in place. This eliminates or at least minimizes the likelihood of the wick 58 being accidentally pulled out of the wick holder 22 when the wick holder 22 is removed to refill the canister 16.

Figure 3:
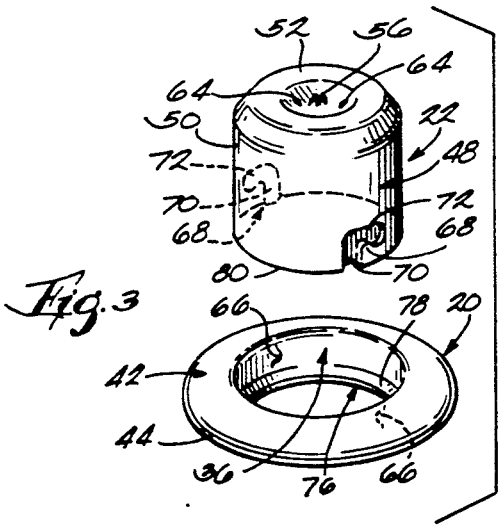
FIG. 3 is an enlarged, exploded view of the wick holder and seat member shown before the seat is installed on the canister.

Locking means are provided on the wick holder 22 and the seat member 20 for releasably locking the wick holder 22 in the installed position. While various suitable arrangements can be used, in the preferred embodiment illustrated, the locking means includes a pair of opposed, radially inwardly extending projections 66 on the sleeve portion 36 of the seat member 20 and a pair of opposed, generally L-shaped grooves 68 in the outer surface 50 of the tubular portion 48 of the wick holder 22. For installation of the wick holder 22, the vertically extending legs 70 of the grooves 68 are aligned with the projections 66, the wick holder 22 is pushed downwardly until the projections 66 bottom out and are aligned with the laterally extending legs 72 of the grooves 68. The wick holder 22 is then rotated (clockwise as viewed in FIG. 3) to a position where the projections 66 are located in the lateral legs 72 of the grooves 68 and thereby prevent the wick holder 22 from being withdrawn from the seat member 20 unless it is rotated in the opposite direction until the projections 66 are aligned with the vertical legs 70 of the grooves 68. Thus, the grooves 68 and projections 66 provide a bayonet type connection.

If desired, the projections 66 can be provided on the tubular portion 48 of the wick holder 22 and the grooves 68 provided in the sleeve portion 36 of the seat member 20.

In the preferred embodiment illustrated, the lower or bottom end 76 of the sleeve portion 36 of the seat member 20 has an in turned annular flange 78 which extends radially inwardly at a downward slope. The lateral legs 72 of the grooves 68 are configured (i.e., slightly inclined) so that, as the wick holder 22 is rotated, the projections 66 cooperate with the lateral legs 72 of the grooves 68 to cam the lower or bottom edge 80 of the tubular portion 48 of the wick holder 22 into engagement with the flange 78 to thereby enhance sealing between the wick holder 22 and seat member 20.

Figure 5:
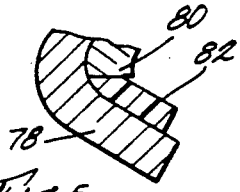
FIG. 5 is an enlarged, fragmentary sectional view of the lower portions of the wick holder and seat member illustrating another embodiment of the invention.

The seal between the wick holder 22 and the seat member 20 may not be fluid tight. FIG. 5 illustrates an alternate embodiment in which an annular sealing ring, such as a gasket 82, is disposed between the annular flange 78 for the seat member 20 and the bottom edge 80 of the wick holder to insure a fluid tight seal between the wick holder 22 and the seat member 20.

From the foregoing description, one skilled in the art can easily ascertain the essential characteristics of the invention and, without departing from the spirit and scope thereof, make various changes and modifications to adapt it to various usages.

I claim:

1. A burner assembly comprising a canister for a combustible liquid including an upstanding neck portion having an inner wall defining an opening for introducing the combustible liquid into the canister and an outer wall terminating in an upper rim portion including an annular lip extending radially outwardly from the outer wall of said neck portion and having an outer surface;

a seat member including a sleeve portion having inner and outer surfaces and an annular flange which extends radially inwardly from the inner surface thereof and has an upper surface, said sleeve portion extending into said canister opening with the outer surface of said sleeve portion in sealing engagement with the inner wall of said canister neck portion, said seat member further including an upper end portion connected to said sleeve portion and having an annular collar extending downwardly over and peripherally around the outer surface of said lip and cooperating with said sleeve portion of said seat member to capture the upper rim portion of said canister neck portion therebetween;

a wick holder including a tubular portion having an outer surface, a lower edge and a top wall having an aperture for receiving an elongated wick with one portion of said wick disposed in the combustible liquid and another portion extending through said aperture and exposed for lighting, said wick holder being mounted for movement relative to said seat member between an installed position wherein a lower part of said tubular portion extends inside said sleeve portion of said seat member with the outer surface of said tubular portion being in close proximity to the inner surface of said sleeve portion and a fill position wherein said wick holder is withdrawn from said seat member to open said canister for introduction of the combustible liquid into said canister through said opening; and locking means on said wick holder and said seat member for releasably holding said wick holder in the installed position, the tubular portion of said wick holder being movable relative to the sleeve portion of said seat member between locked and unlocked positions and said locking means being operable to move the lower edge of said tubular portion into engagement with the upper surface of said flange during movement of said wick holder to the locked position.

2. A burner assembly according to claim 1 wherein said cap member is made from a crimpable metal;

said lip on said canister neck portion has a lower edge, and said outer collar on said seat member has a lower portion and is crimped against said lip with said lower portion underneath said lower edge of said lip.

3. A burner assembly according to claim 2 wherein said locking means comprises a pair of diametrically opposed projections on one of the inner surface of said sleeve portion of said seat member and the outer surface of said tubular portion of said wick holder and a pair of opposed, generally L-shaped grooves in the other of the inner surface of said sleeve portion of said seat member and outer surface of said tubular portion of said wick holder for receiving said projections, each of said grooves including a vertically extending leg for receiving a said projection when the tubular portion of said wick holder is moved downwardly into said sleeve portion of said seat member and a laterally extending leg for receiving a said projection when said wick holder has been moved to the installed position and then rotated relative to the tubular portion of said seat member to move said wick holder to the locked position.

4. A burner assembly according to claim 3 wherein said projections are on said sleeve portion of said seat member and said grooves are on said tubular portion of said wick holder.

5. A burner assembly according to claim 3 wherein said canister is made from a synthetic thermoplastic or thermosetting material.

6. A burner assembly according to claim 1 including a sealing ring disposed between the lower edge of the tubular portion of said wick holder and the upper surface of the flange on the sleeve portion of said seat member for establishing a fluid tight seal therebetween when said wick holder is in the locked position.

7. A burner assembly according to claim 1 wherein said wick holder is made from a metal;

the top wall of said wick holder includes a plurality of upstanding ears surrounding said aperture, said ears being arranged so that, after the wick has been inserted through said aperture, said ears can be squeezed into contact with the wick to thereby lock the wick in place against being accidentally pulled from the wick holder.

8. A burner assembly according to claim 7 wherein said wick holder is formed by stamping; and said ears are formed from the portion of the top wall of said wick holder pushed out to form said aperture.

* * * * *